US007650774B2

(12) United States Patent
Kato et al.

(10) Patent No.: US 7,650,774 B2
(45) Date of Patent: Jan. 26, 2010

(54) TANDEM PRESS APPARATUS

(75) Inventors: Shinji Kato, Nisshin (JP); Hisanori Nakamura, Toyota (JP); Asahiko Hasebe, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 366 days.

(21) Appl. No.: 10/586,158

(22) PCT Filed: Dec. 27, 2004

(86) PCT No.: PCT/JP2004/019824

§ 371 (c)(1),
(2), (4) Date: Jul. 14, 2006

(87) PCT Pub. No.: WO2005/068104

PCT Pub. Date: Jul. 28, 2005

(65) Prior Publication Data

US 2008/0229939 A1 Sep. 25, 2008

(30) Foreign Application Priority Data

Jan. 16, 2004 (JP) ..... 2004-009526

(51) Int. Cl.
*B21J 11/00* (2006.01)

(52) U.S. Cl. ..... 72/405.11; 72/405.01; 72/405.16

(58) Field of Classification Search ..... 72/405.01, 72/405.02, 405.04, 405.05, 405.1, 405.11, 72/405.13, 405.16, 420, 421; 198/468.2, 198/468.9; 269/56, 58; 414/715.1
See application file for complete search history.

(56) References Cited

U.S. PATENT DOCUMENTS 4,513,602 A * 4/1985 Sofy ..... 72/405.13
5,257,899 A * 11/1993 Asakura et al. ..... 198/468.4
5,383,348 A 1/1995 Michael et al.

(Continued)

FOREIGN PATENT DOCUMENTS

EP 0 930 110 12/1998

(Continued)

OTHER PUBLICATIONS

First Office Action from the Chinese Patent Office for Chinese Patent Application No. 200810095321.9.

*Primary Examiner*—Edward Tolan
(74) *Attorney, Agent, or Firm*—Finnegan, Henderson, Farabow, Garrett & Dunner, LLP

(57) ABSTRACT

The present invention intends provided a tandem pressing apparatus which can shorten and the conveying distance i.e. the conveying time without increasing conveying speed of the work.

A tandem pressing apparatus of the present invention is comprised of a tandem pressing line constructed by plural tandem presses 10 and 20 disposed side by side, and a work conveying apparatus 70 including a main member and an arm portion. Each of the tandem press includes a bed, 11, plural uprights 13*a* to 13*d* studded on the bed, and a slide 15 supported on the uprights to be ascended or descended. The main member 62 and 63 is provided at a portion located inside the uprights of the adjacent two tandem presses constructing the tandem pressing line and does not interfer with the slide. The arm member 65 is held on the main member to transfer the work having been pressed by the upstream tandem press to the downstream tandem press.

14 Claims, 6 Drawing Sheets

U.S. PATENT DOCUMENTS

| | | | | |
|---|---|---|---|---|
| 5,520,502 | A | 5/1996 | Liljengren et al. | |
| 5,582,061 | A * | 12/1996 | Harsch et al. | 72/405.1 |
| 5,584,205 | A * | 12/1996 | Harsch et al. | 72/405.02 |
| 5,595,087 | A * | 1/1997 | Harsch | 72/405.16 |
| 6,000,327 | A * | 12/1999 | Moriyasu et al. | 100/207 |
| 7,128,198 | B2 * | 10/2006 | Yoshida et al. | 198/468.4 |
| 7,316,149 | B2 * | 1/2008 | Baba et al. | 72/405.09 |
| 7,428,837 | B2 * | 9/2008 | Takayama | 72/20.5 |
| 7,481,310 | B2 * | 1/2009 | Dodo | 198/465.3 |
| 2002/0192058 | A1 | 12/2002 | Harsch et al. | |

FOREIGN PATENT DOCUMENTS

| | | |
|---|---|---|
| JP | 6-47465 | 2/1994 |
| JP | 2002-307116 | 10/2002 |

* cited by examiner

TANDEM PRESS APPARATUS

This application is a 35 USC 371 of PCT/JP2004/019824 filed Dec. 27, 2004.

TECHNICAL FIELD

The present invention relates to a tandem pressing apparatus comprised of a tandem pressing line and work conveying apparatus.

RELATED BACKGROUND ART

As one of a press apparatus continuously pressing works sequentially a tandem pressing apparatus has been known. It includes a tandem pressing line in which plural tandem press are disposed, and a work conveying apparatus conveying works between adjacent tandem presses. The tandem press includes a bed, four uprights studded on the bed, a crown fixed at upper portions of the uprights, and a slide supported by the crown to be ascended and descended. To a bolster mounted on the bed a lower mold is set, while to the slide an upper mold is set.

For conveying the works between the adjacent tandem presses, a work conveying apparatus such as a conveying robot etc. has been used. FIGS. 7 and 8 show a work conveying apparatus for conventional tandem press disclosed in the Japanese Publication H6-47465. In this conventional art, a conveying robot 160, disposed between the first pressing machine 150 and the second pressing machine 155 disposed adjacent thereto, conveys the works from the first pressing machine 150 to the second pressing machine 155. A front/rear of the work is reversed during the conveyance thereof. Onto an arm 161 of the conveying robot 160 a vacuum cap 162 for conveying the work is mounted, while onto an upper mold 156 of the second pressing machine 155 a vacuum cap 158 for holding the work is mounted.

When the upper mold 151 ascends after completion of pressing by the first pressing machine 150, the arm 161 of the conveying robot 160 enters into the space between the upper mold 151 and the lower mold 152. Thus, the vacuum cup 162 for the work conveying absorbs the work W. The conveying robot 160 makes the work W to float up from the lower mold 152, and takes out the work from space between the first pressing machine 150 and the second pressing machine 160 at once, to reverse the front/rear thereof.

Then, being faced to space between the upper mold 156 and the lower mold 157 of the second pressing machine 155, the work W is pushed upwardly to be pressed onto the vacuum cap 158 for the work holding.

When the work W is absorbed to the vacuum cap 158, the vacuum cap 162 for the work conveying releases the work W, so that the conveying robot 160 is stood by at the area between the first pressing machine 150 and the second pressing machine 155. In this way, the work W having been pressed by the first pressing machine 150 is reversed the front/rear thereof, then supplied or fed to the upper mold of the second pressing machine 155.

In the above conventional art, the conveying robot 160 conveying the work W between the first pressing machine 150 and the second pressing machine 155 is disposed between the both pressing machines 150 and 155. As a result, a space 165 required for disposing the conveying robot 160 between the first and second pressing machines 155 makes a conveying distance (conveying pitch P) of the work longer.

Increase of the conveying pitch P makes a conveying time of the work W between the first and second pressing machines 150 and 155 longer, so that productivity of the pressed article decreases. The productivity can be somewhat improved by increasing the conveying speed of the work W, but absorbing ability by the vacuum cup 162 for the work conveying is apt to be shortened. Further, large drive source will be required for the high-speed conveyance.

The Japanese Patent Publication No. 2002-307116 has disclosed a conveying apparatus (transfer feeder) of a transfer press. As shown in FIGS. 9 and 10, the transfer press 170 includes a bed 171, four up-rights 173, a crown 175 and a slide 177. A lower mold is attached to a bolster 172 of the bed 171, while an upper mold is attached to the slide 177.

Spanning the adjacent transfer presses 170, a conveying apparatus 80 is disposed. It includes a pair of lifting beams 181 disposed along conveying direction of the work, servo motors 184 for ascending/descending the lifting beams 181, carriers 187 movably attached to the lifting beams 181, linear motors (not shown) for driving the carriers 187 in the conveying direction, and work holding means 194 having a cross bar 192 and a vacuum cap 193.

Proximity portions of the lifting beam 181 in the work conveying direction have length correspond to each of conveying areas T2, T3 and T4. The lifting beams 181 in the conveying areas T2 and T4 are positioned inside the lifting beam 181 in the conveying area T3. The servo motors 184 are supported on the uprights 171 by supporting members 185 to drive the lifting beams 181 upwardly and downwardly. The carriers 187 are attached to the linear motors, to be moved relative to the lifting beams 181.

The work W is conveyed by this conveying apparatus 180 in the following manner. In the conveying area T3, at the timing when the slide 177 having finished processing at the processing station W3 moves upwardly, the carrier 187 positioned at the predetermined height is moved to end of the processing station W3 along the lifting beam 181. With the vacuum cap 193 being positioned at center of the processing station W4, the lifting beam 181 descends to absorb the work W. Then, the lifting beam 187 ascends, the carrier 187 moves to end of the processing station W4, the vacuum cap 193 moves to a center of the processing station W4, and the lifting beam 181 descends to release the work W.

Next, the lifting beam 181 is ascended before the slide 177 of the processing station W4 fully descends. The carrier 187 is returned to substantial center of the conveying area T3 not to interfere with the slide 177 and the mold. Thereafter, after completion of the processing at the processing station W4, the lifting beam 181 and the carrier 187 are operated in the conveying area T4, in the same manner as that of the conveying apparatus in the conveying area T3.

This conveying apparatus 180 extending between the processing stations W2 and W3, and between the processing stations W3 and W4, is not for the tandem press but or the transfer press. In the transfer press having singe bed, whole of the processing station forms pair, so that an interval between the adjacent processing stations is short. Thus, there exits no space for disposing the conveying apparatus between the adjacent processing stations. For this reason, the conveying apparatus may be disposed over or spanning the adjacent processing stations.

In addition, the servo motor 184 driving the lifting beam 181 in the up-down direction consumes much power.

In the tandem pressing line, different from the transfer pressing line, one slide is provided for one bed in each of tandem presses, which means each tandem press is independent from remaining tandem presses. Accordingly, corresponding to increase/decrease of the numbers of articles, the tandem press can be added or removed. Also, even when the particular tandem press is broken, the article can be produced by the remaining normally operating tandem presses. Thus, it has flexibility in the article producing. However, the tandem press has disadvantages that the conveying distance longer than that of the transfer press decreases the producing ability.

SUMMARY OF THE INVENTION

The present invention has been made in view of the above circumstances, and intends provided a tandem pressing apparatus which can shorten the conveying time without increasing conveying speed of the work, and can improve productivity up to level equivalent to that of the transfer press.

The basic technical concept of the present invention is to construct a tandem pressing apparatus by a tandem pressing line and a work conveying apparatus. In the tandem pressing line, plural tandem presses are disposed by an interval as small as possible. The work conveying apparatus is disposed by utilizing a space formed between a slide and uprights of the tandem press.

The tandem pressing apparatus of the present invention is, as set forth in the claim 1, comprised of the tandem pressing line constructed by plural tandem presses disposed side by side, and the work conveying apparatus including a main member and an arm member.

Each of the tandem presses includes a bed, plural uprights studded on the bed, and a slide supported on the uprights to be ascended (lifted) or descended (lowered). The main member of the work conveying apparatus is provided at a portion or area which is located inside the uprights of the adjacent two tandem presses constructing the tandem pressing line, and which does not interfered with the slide. The arm member is held on the main member to transfer the work having been pressed by the upstream tandem press to the downstream tandem press.

In this tandem pressing apparatus, the tandem pressing line sequentially presses the work, and the work conveying apparatus conveys the work between the adjacent tandem press. That is, the arm member of the work conveying apparatus driven by the main member moves to the upstream processing station, to hold the work having been pressed by the upstream tandem press by an work holding portion thereof. Then, by driving of the arm member by the main member, the work holding portion moves to the downstream tandem press to feed or convey thereto.

According to the tandem pressing apparatus of the present invention, when the work having been pressed by the upstream tandem press is transferred to the downstream tandem press by the work conveying apparatus, the interval between the upstream tandem press and the downstream tandem press can be shortened near to the minimum. As a result, distance between the first tandem press and the second tandem press can be shortened as small as possible. The conveying time can be shortened and the numbers of pressed works per a unit time can be increased, whereby the productivity is improved. In addition, the work conveying apparatus disposed at position or area inside the uprights of the tandem press not interfering the slide, does not interfere with the slide ascending and descending during the pressing.

According to the tandem pressing apparatus of the claim 2, disposing the main member in the space formed between the slide and the uprights of the tandem press can minimize increase of width of the tandem press (dimension orthogonal to the conveying direction). According to tandem pressing apparatus of the claim 3, interference between the main member and the slide can be prevented surely. According to tandem pressing apparatus of the claim 4, construction of the work conveying apparatus can be made simple.

According to tandem pressing apparatus of the claim 5, the main member is mounted onto the guiding member disposed by utilizing the space formed between the slide and the uprights of the tandem press. As a result, width of the tandem press (dimension orthogonal to the conveying direction) can be minimized. According to tandem pressing apparatus of the claim 6, interference between the main member and the slide can be prevented surely. According to tandem pressing apparatus of the claim 7, the work can be conveyed by the work conveying apparatus surely.

According to tandem pressing apparatus of the claim 8, the arm member, especially the work holding portion thereof, can be moved or shifted in the work conveying direction and/or in the up-down direction smoothly. According to tandem pressing apparatus of the claim 9 and 10, the work holding portion of the arm member can be suitably moved or shifted by the tandem press in the lateral direction or up-down direction. According to tandem pressing apparatus of the claim 11, only short time and only small labor are required for operating the work conveying apparatus. Also, the work conveying apparatus operates surely.

In the following, various embodying modes of the present invention will be explained.

A. Tandem Press, Tandem Pressing Line

Each of tandem presses includes a bed, a bolster, uprights, a crown and a slide. Plural (two or more than three) tandem presses disposed side by side construct a tandem pressing line. Plural tandem presses in the tandem pressing line press the work sequentially.

In an area which is located inside the upright(s) of the tandem press(es) and which does not interfere with the slide, the main member of the work conveying apparatus is disposed. Between the slide and the plural uprights positioned at four corners around the bed and the crown, relatively larger space is preferably formed. Concretely, the bed and the slide preferably have rectangular shape in the plane view in which longer edge corresponds to the direction orthogonal to the conveying direction. Space between a longer edge of the bed etc. and the uprights is preferably narrow. To the contrary, wide space between a shorter edge of the bed etc. and the uprights preferably is used to dispose the work conveying apparatus.

B. Work Conveying Apparatus

The work conveying apparatus which conveys the work between the adjacent tandem presses (briefly called "conveying apparatus" as occasion demands) includes the main member and the arm member. The main member is disposed in the area which is located inside the upright of the tandem press and which does not interfere with the slide. The arm member held by the main member is provided with the work holding portion at a top end thereof, to convey the work received from the upstream processing station to the downstream processing station. The conveying apparatus can be classified into two types depending on a fixing manner of the main member to the uprights, and a detail construction of the arm member. The conveying apparatus can be a conveying robot controlled by a CPU.

(i) First Type

In the first type, the main member is disposed inside the uprights etc. of the upstream tandem press, and the arm member is rockably attached to the main member.

a. Main Member

The main member has function to drive the arm member, and is disposed between the upright of the upstream tandem press and the upright of the downstream tandem press, and inside the adjacent uprights. Here, "disposing inside the adjacent uprights" means to dispose and attach the main member on inner side surfaces of the uprights facing to the slide, for example. Also, the main member is disposed outside a contour of the slide in the plane view, so as not to interfere with the slide.

Concretely, the main member is disposed in the space formed among the slide of the upstream (first) tandem press, the slide of the downstream (second) tandem press, and the uprights at one side in the conveying direction. It is fixed to the inner side surface of the upright. This space positioned between the upstream processing station and the downstream station in the conveying direction, is convenient for disposing the main member therein.

In detail, the main member is fixed only to the downstream uprights of the upstream tandem press, only to the upstream uprights of the downstream tandem press, or to both of them to be spanned.

The main member sufficiently can be fixed to the uprights at least one side relative to the conveying direction of the work, but can be fixed to the uprights of both sides. Fixed portion on the upright can range from the intermediate part to the upper portion thereof.

b. Arm Member

The arm member extended from the main member has the work holding portion at the top end thereof, and moves between a position upstream processing station, and a position to enter into and retract from the downstream processing station. The work holding portion can move or displace horizontally (laterally) in the horizontal surface, for handing (giving cross) the work received from the upstream processing station to the downstream process station. The arm member can be constructed to be shrinked and extended, or to be bent at the intermediate portion.

(ii) Second Type

In the second type, the guiding member is spanned between the upstream tandem press and the downstream tandem press inside the upright thereof. The main member is held by the guiding member slidably. The arm member can rock in the plane including the guiding member, for example.

a. Guiding Member

The guiding member has length corresponding to length between the upstream processing station and the downstream pressing station. The first portion (for example, an upstream end portion) is extended between the slide and the uprights of the upstream tandem press, while the second portion (for example, an intermediate portion) is extended between the slide and the uprights of the downstream tandem press. For example, the upstream end portion is fixed to the inner side surface of the downstream upright of the upstream tandem press, while the intermediate portion is fixed to the inner side surface of the upstream upright of the downstream tandem press.

The guiding member(s) are preferably fixed to the uprights at both sides relative to the work conveying direction, but the guide member can be fixed to the uprights only at one side.

Also, the guiding member can be fixed to an intermediate portion of the uprights in the height direction thereof.

b. Main Member

The main member is slidably held on the guiding member fixed to the inner side surface of the adjacent uprights of the upstream tandem press and the downstream tandem press. It is mounted onto the guiding member and linearly movable between a lateral space of the upstream processing station or in the vicinity thereto, and a lateral space of the downstream pressing station or in the vicinity thereto. This movement moves the work holding portion mainly in the conveying direction. Moving upwardly, the main member enters into inner space of the upright of the upstream tandem press, for example to the space formed between the slide and the uprights. Here, the main member positioned outside the slide contour in the plane view, does not interfere with the ascending or descending slide.

Similarly, moving downwardly, the main member enters into inner space of the upright of the upstream tandem press, for example to the space formed between the slide and the uprights. Here the main member positioned outside the slide contour in the plane view does not interfere with the ascending/descending slide.

c. Arm Member

The arm member rocks, relative to the main member, in the plane including the guiding member that is around an axis orthogonal to the moving direction of the main member. In detail, one end of the arm member is pivoted on the main member, and to the other end thereof a cross bar provided with the work holding portion is joined. The arm member rocks in the plane including the guiding member (normally a vertical plane) so that the other end moves upwardly and downwardly, to thereby move the work holding portion mainly in the up-down direction. It rocks when receiving the work from the upstream tandem press in the space thereof, and rocks when handing the work to the downstream tandem press in the space thereof. Combination of the movement of the main portion and rocking of the arm member moves the work holding portion in the vertical plane along the oblong track.

The guiding member can be constructed by a multi-joint arm including plural joints to be bent at the intermediate portion thereof. Two arm portions including one joint, or three arm portions including two joints forms the arm member. For example, the first arm portion of which one end is pivoted to the main member, and the second arm portion of which one end is pivoted to the other end of the first arm portion and of which other end is joint to the cross bar, can form the arm member. Also, when the pair of main members are mounted to the guide members disposed at both ends of the slide respectively, one end and other end of the cross bar are joined to one side and other side arm member respectively.

EMBODYING MODE OF THE INVENTION

In the following, an embodying mode of a tandem pressing line of the present invention will be explained.

Preferred Embodiment

In the following, an embodiment of the present invention will be explained with reference to attached drawings. This embodiment corresponds to the above second type explained in the column of the embodying mode.

a. Tandem Press, Tandem Pressing Line

Figure 1:
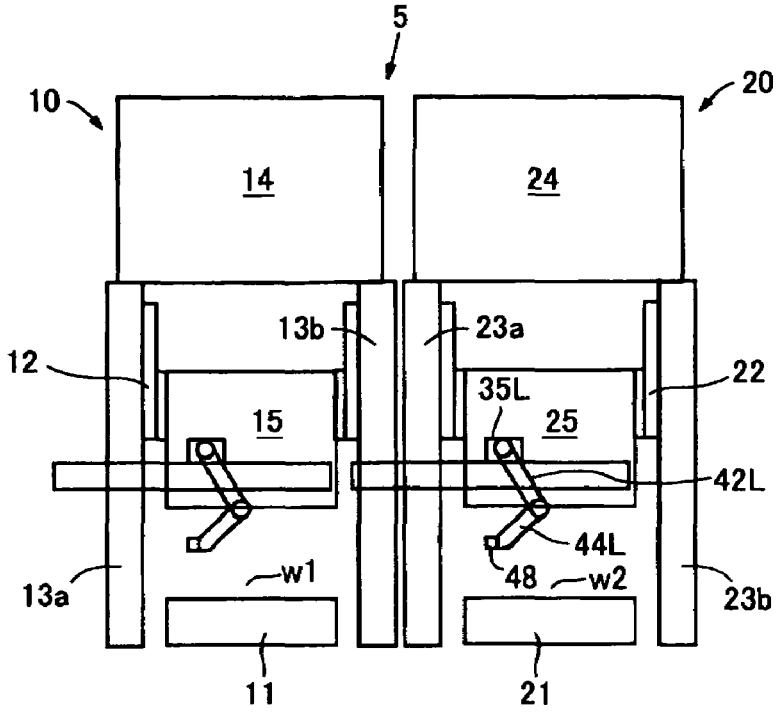
FIG. 1 is a front view showing an outline of an embodiment of the present invention.
Figure 2:
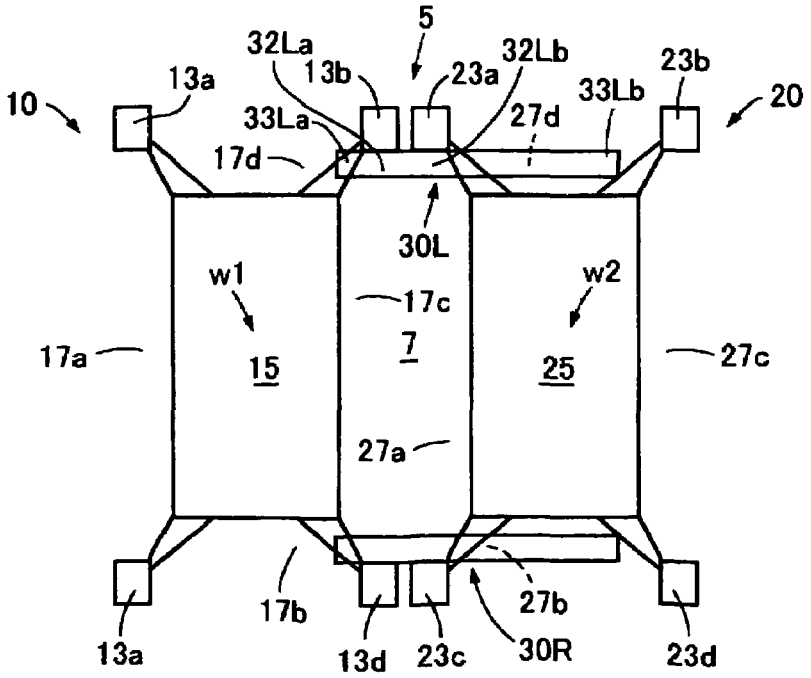
FIG. 2 is a cross-section view taken along a line 2-2 in FIG. 1.

As shown in FIGS. 1 and 2, plural (only two of them are shown) tandem presses 10 and 20 are disposed side by side along a straight line to construct a tandem press line.

An upper (left in FIG. 1) first tandem press 10 is comprised of a bed 11, four uprights 13*a* to 13*d* studded on the bed 10, a crown fixed to the uprights 13*a* etc., and a slide 15 attached to the crown to be ascended (lifted) and descended (lowered).

The bed 11 has a rectangular shape which is longer in the work conveying direction (left-right direction in FIG. 2). On an upper surface of a bolster (not shown) mounted on the bed, a lower mold (not shown) is fixed. Between the slide 15 and the uprights 13*a* and 13*b* etc., a support 12 is interposed. A space formed between the slide 15 and the uprights 13*b* and 13*d* is small in the conveying direction but large in the orthogonal direction to the conveying direction. The slide 15 is ascended and descended by a driving mechanism (not shown) relative to the crown 14, and an upper mold (not shown) is fixed on a lower surface thereof.

A downstream (right in FIG. 1) second tandem press 20 has a construction basically same as that of the first tandem press 10, so corresponding members are shown by the reference numerals of twenties. However, shape of the lower and upper molds, and descending amount etc. of the slide 25 are different. Length of a space 5 formed between the first tandem press 10 and the second tandem press 20 in the conveying direction is smaller than length of the tandem presses 10 and 20 in the conveying direction.

b. Work Conveying Apparatus

A work conveying apparatus 50 disposed between the first tandem press 10 and the second tandem press 20 is comprised of a guiding beams (guiding member) 30L and 30R, running members (main member) 35L and 35R, rocking mechanisms (arm member) 40L and 40R, and a cross bar 48. Left and right running members 35L and 35R run along the left and right guiding beams 30L and 30R, the left and right rocking mechanism 40L and 40R are pivoted on the running members 35L and 35R, and the cross bar 48 connects the both rocking mechanisms 40L and 40R. Because the guiding beam 30L etc. at one side and the guiding beam 30R etc. at other side have symmetrical construction, the one side guiding beams 30L etc. will be explained.

A first portion 32La of the guiding beam 30 is fixed to an inner side surface of a downstream upright 13*b* of the first tandem press 10, and a second portion 32Lb is fixed to an inner side surface of an upstream upright 23*a* of the second tandem press 20.

An upstream end 33La extends, in a space 17*d* between the slide 15 and the upright 13*b*, to this side of lateral space of the pressing station W1 of the first tandem press 10. A downstream end 33Lb extends, in a space 27*d* between the slide 25 and the upright 23*a*, to that side of lateral space of the pressing station W2 of the second tandem press 20.

Figure 3:
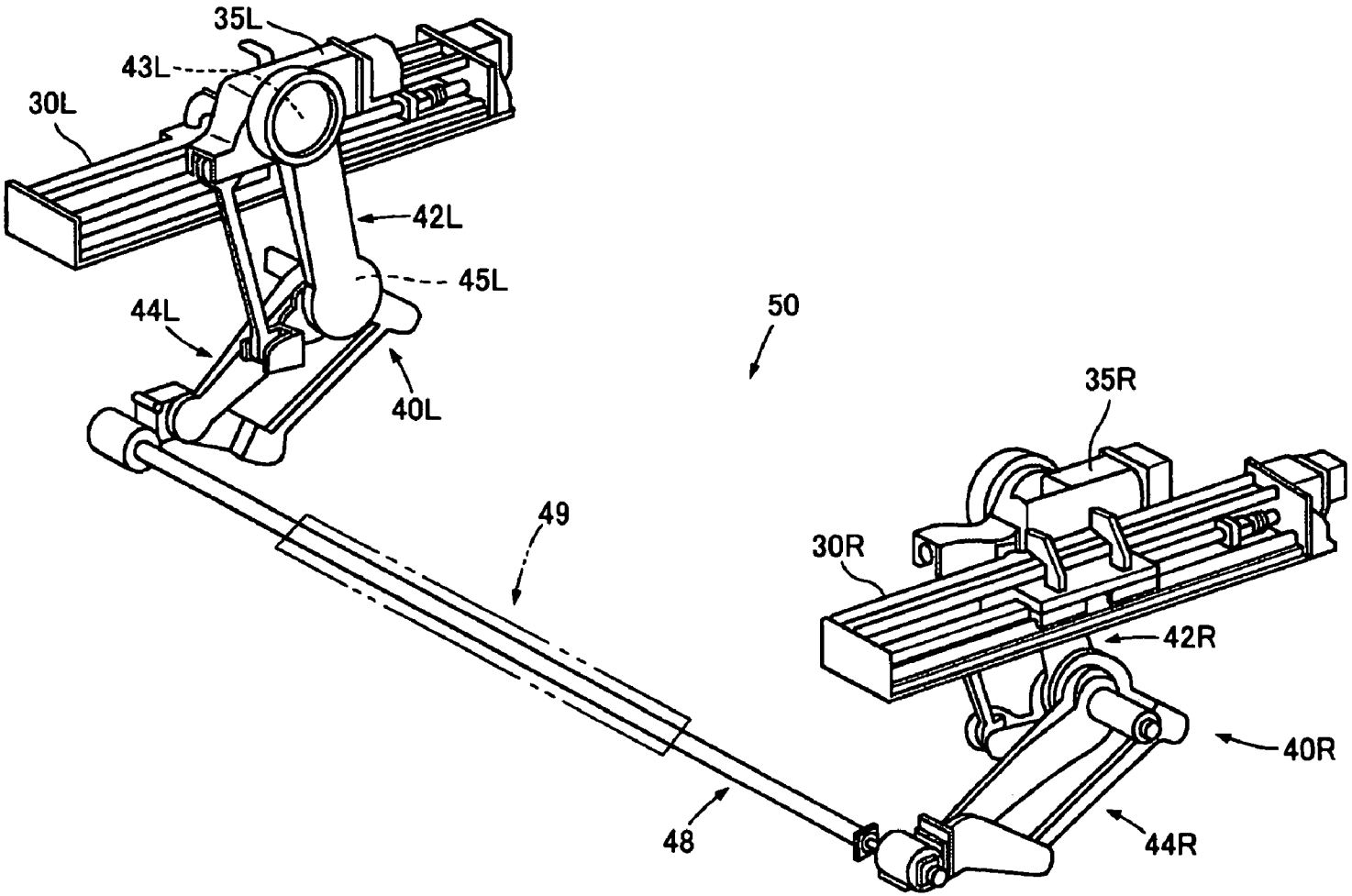
FIG. 3 is a perspective view showing detail of a work conveying apparatus of the embodiment.
Figure 4:
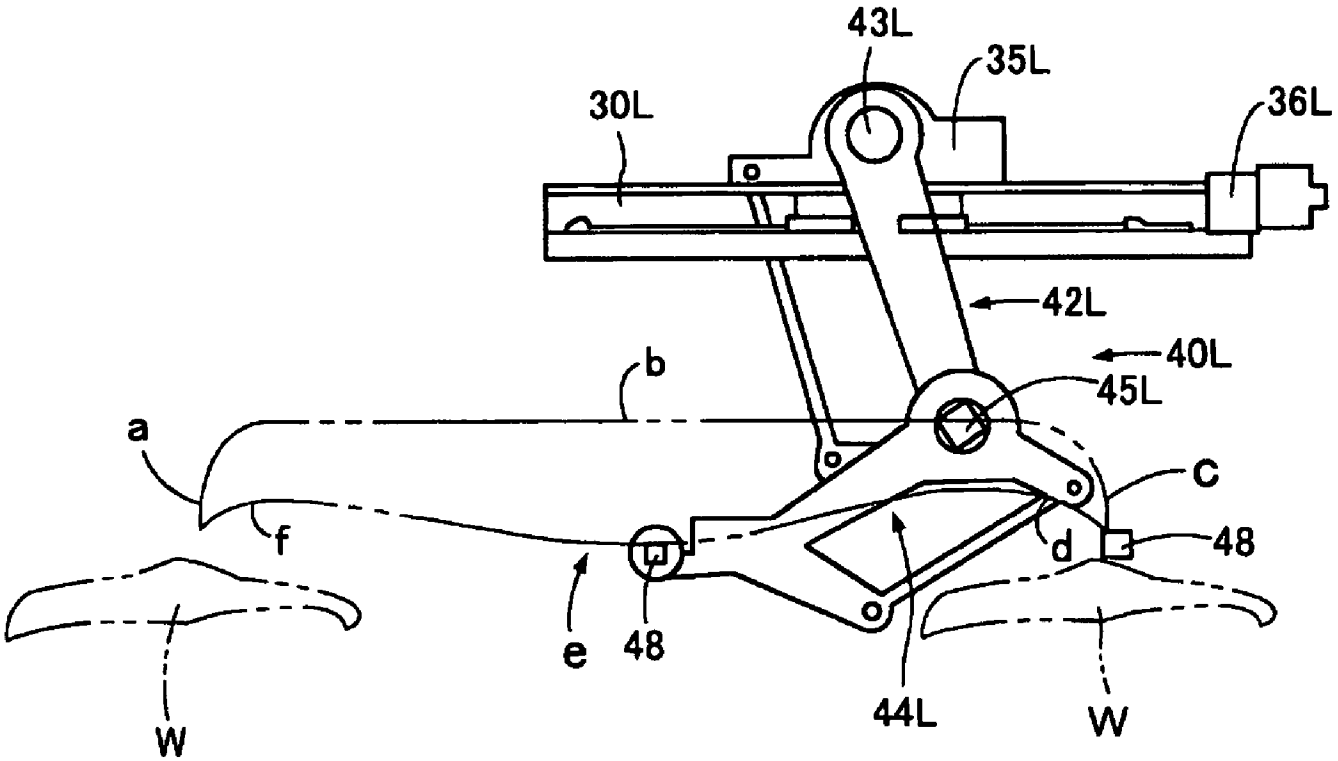
FIG. 4 is a front view showing detail of a work conveying apparatus of the embodiment.

In FIGS. 3 and 4, the running member 35L mounted on the guiding beam 30L is driven by a first motor 36L provided at the one end of the guiding beam 30 L, to be moved linearly and reciprocately between the upstream end 33La and the downstream end 33Lb. The rocking mechanism 40L includes a first rocking member 42L of which one end is pivoted to the running member 35L, and a second rocking member 44L pivoted on other end of the first rocking member 42L. The first and second rocking members 42L and 44L are rockable in the vertical plane including the guiding beam 30L. The first rocking member 42L driven by a second motor 43L provided at one end thereof rocks around the one end, while the second rocking member 44L driven by a second motor 45L provided at one end thereof rocks around the one end. To the other end of the second rocking member 44L, one end of the cross bar 48 is joined.

On the other side guiding beam 30R the running member 35R is mounted, and to the running member 35R the running member 40R in pivoted. To the other end of the second rocking member 44R the other end of the cross bar 48 is joined. The cross bar 48 extending in the direction orthogonal to up-down stream direction, has a work holding portion 49 at an intermediate portion.

Next, an operation of this embodiment will be explained with reference to FIGS. 1 to 4. The work W having been subject to the first pressing by the first tandem press 10 is carried out by the conveying apparatus 50 from the first pressing station W1 of the first tandem press 10. It is carried into the second pressing station W2 of the second tandem press 20 by the conveying apparatus 50, to be subjected to the second pressing by the second tandem press 20.

In detail, the running member 35L is moved on the guiding beam 30L to the left end thereof by the first motor 36L. Synchronizing with ascent of the slide 15 and the upper mold of the first tandem press 10, the first and second rocking members 42 L and 44L are rocked. The first rocking member 42L is rocked in the anti-clockwise direction by the second motor 43L, while the second rocking member 44L is rocked in the clockwise direction by the third motor 45L. Consequently, as shown by a in FIG. 4, combined movement of the two rocking members 42L and 44L moves the cross bar 48 vertically upwardly, so that the work W is taken out from the pressing station W1 of the first tandem press 10.

Thereafter, with the cross bar 48 ascended, the running member 35L is moved on the guiding beam 30L to the right end. At the rightmost end position, synchronizing with ascent of the slide 25 and the upper mold of the second tandem press 20, the first rocking member 42L is rocked in the clockwise direction by the second motor 43L, while the second rocking member 44L is rocked in the anti-clockwise direction by the third motor 45L. Consequently, as shown by c, the cross bar 48 moves vertically downwardly, so that the work W is put on the pressing station W2 of the second tandem press 20.

After pressing of the work W by the second tandem press 20, synchronizing with ascent of the slide 25, the running member 35L is moved left on the guiding beam 30L slightly by the first motor 36L. Simultaneously, the first rocking member 42 is rocked in the anti-clockwise direction slightly by the second motor 43L, and the second rocking member 44L is rocked in the clockwise direction slightly by the third motor 45L. Consequently, as shown by d in FIG. 4 combination of three movements moves the cross bar 48 upwardly in the oblique direction. Then, as shown by e, the running member 35L is moved left on the guiding beam 30L by mainly the first motor 36L.

Near to the left end, synchronizing with ascent of the slide 15 of the first tandem press 10, the running member 35 is moved left on the guiding beam 30L by the first motor 36L. Simultaneously, the first rocking member 42L is rocked in the clockwise direction by the second motor 43L slightly, and the second rocking member 44L is rocked in the anti-clockwise direction by the third motor 45L slightly. Consequently, as shown by f, the cross bar 48 is moved downwardly in the oblique direction.

According to the above mentioned embodiment, following advantages can be obtained. Firstly, the conveying distance of the work W i.e. the conveying pitch P can be shortened. Short Conveying pitch P has been realized by making the space 5 between the first tandem press 10 and the second tandem press 20 as small as possible. Furthermore, distance between the tandem presses 10 and 20 can be shortened, without changing the conveying speed of the work W. Thus, the numbers of pressing operations per the unit time can be increased, to thereby improve the productivity.

Secondary, width increase of the tandem press can be avoided. This is rendered by effective usage of the space in the tandem press 10 and the tandem press 20, when the work conveying apparatus 70 is disposed in the tandem presses 10 and 20. In detail, as apparent from FIG. 2 (plane view), quadrilateral frame-shape spaces 17*a* to 17*d* exist between the slide 15 and the four uprights 13*a* to 13*d*. Relatively wide one side space 17*d* and the other side space 17*b* of the first tandem press 10 are used for disposing the upper ends 33La etc. of the guiding beams 30L and 30R.

The downstream (right side) space 17*c* allows the upward movement of the cross bar 48.

Similarly, relatively wide one side space 27*d* and the other side space 27*b* of the second tandem press 20 are used for disposing the upper ends 33La etc. of the guiding beams 30L and 30R.

The upstream (left side) space 27*a* allows the downward movement of the cross bar 48.

Thirdly, the cross bar 48 does not interfere with the slide 15 of the first tandem press 10 and the slide 25 of the second tandem press 20, when it enters into and retracts from the first pressing station W1, or the second pressing station W2. This is rendered by combination of the linear movement of the running members 35L and 35R relative to the guiding beams 30L and 30R, and rocking movement of the rocking mechanisms 40L and 40R relative to the running members 35L and 35R. Thank to such combination, the cross bar 48 moves along the moving track shown by references a to f in FIG. 4. In connection with it, the guiding beams 30L and 30R fixed and not moving upwardly or downwardly consumes only small power, compared with the conventional art.

Finally, conveyance of the work W by the cross bar 48 having the work holding portion 49 becomes stable. This is rendered by arrangement that the guiding beams 30L and 30R, the running members 35L and 35R, and the rocking mechanisms 40L and 40 R all of which are disposed at both sides of the first and second tandem presses 10 and 20, and the other ends of the first and second rocking members 44L and 44R are joined to the both ends of the cross bar 48. The cross bar 48 receiving the driving force at the both ends thereof is hardly twisted or bent when it conveys the work W.

(Deformed Sample)

Figure 5:
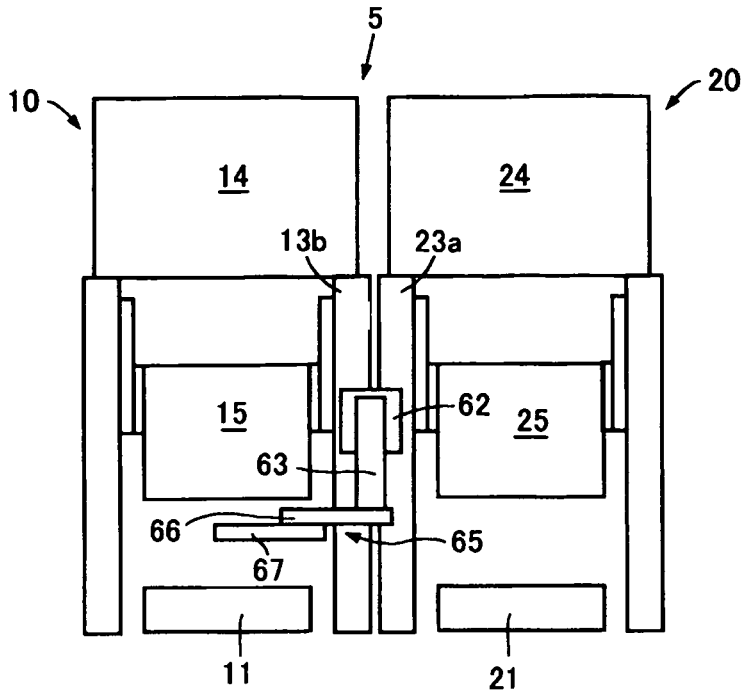
FIG. 5 is a front view showing a deformed sample of the above embodiment and corresponds to FIG. 1.
Figure 6:
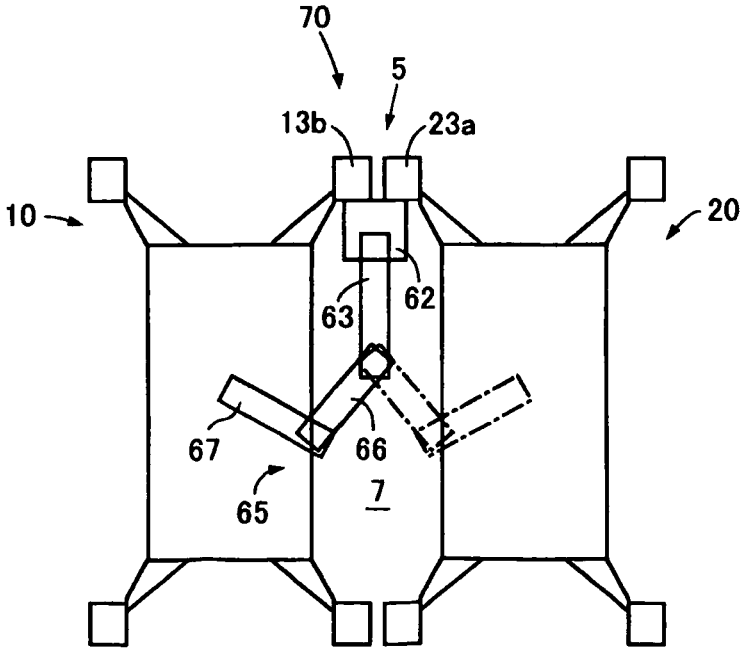
FIG. 6 is a cross-sectional view taken along a line 6-6 in FIG. 5.
Figure 7:
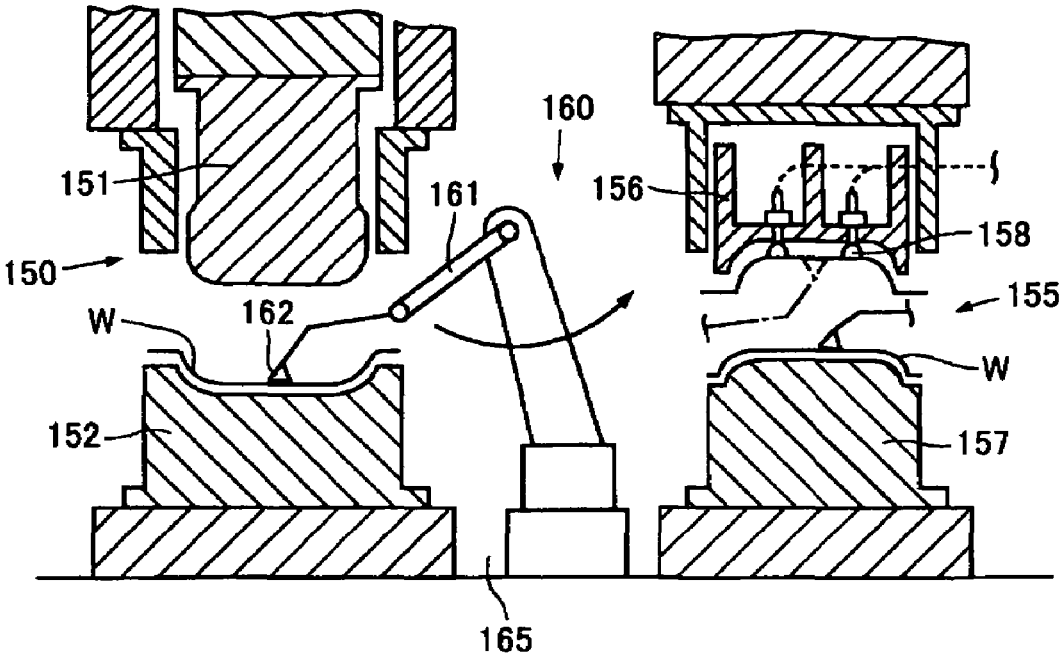
FIG. 7 is a front sectional view showing a first prior art.
Figure 8:
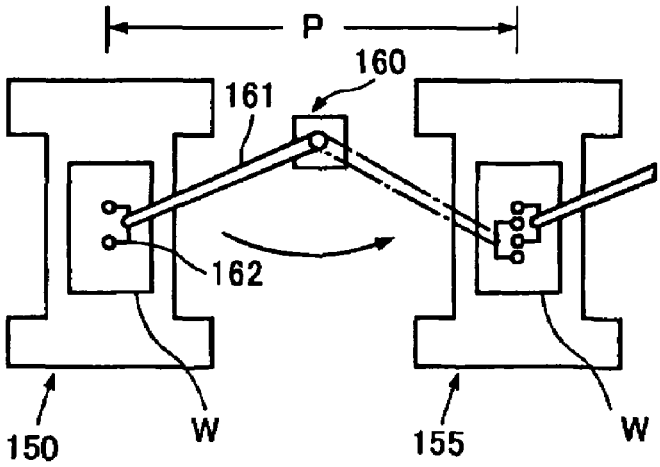
FIG. 8 is a plane view showing the first prior art.
Figure 9:
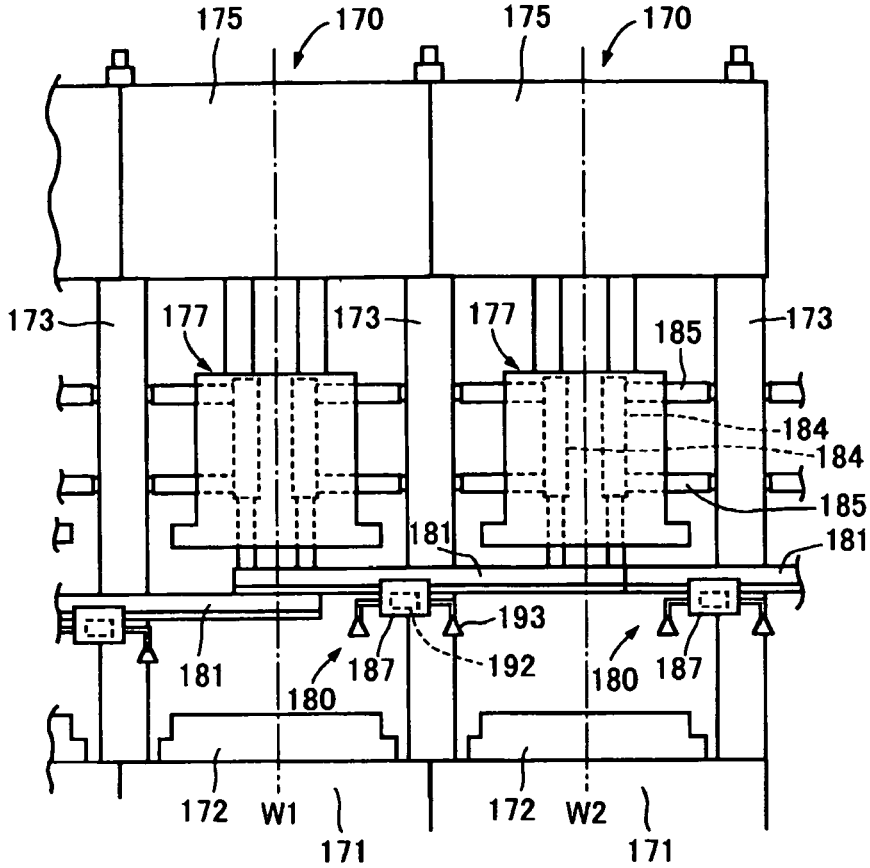
FIG. 9 is a front sectional view showing a second prior art.
Figure 10:
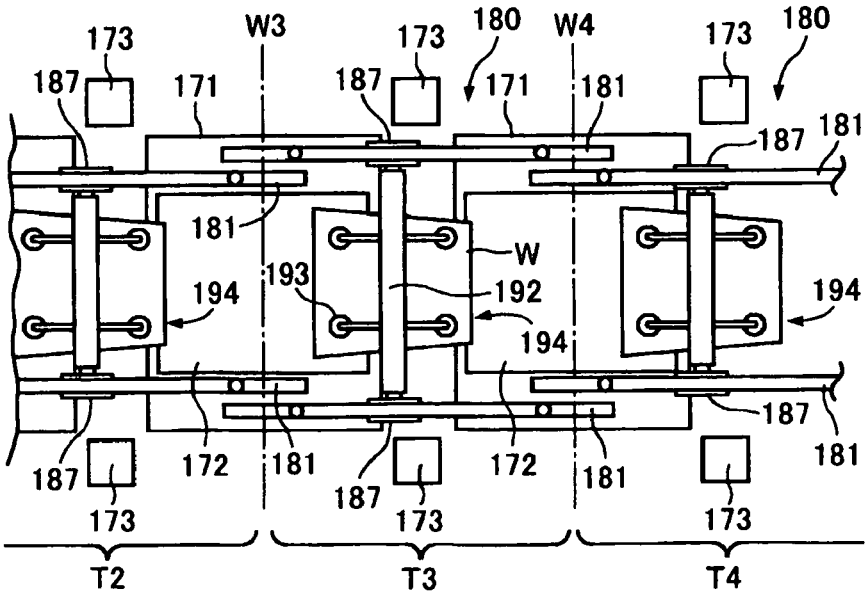
FIG. 10 is a plane view showing the second prior art.

In a deformed sample shown in FIGS. 5 and 6, a work conveying apparatus 70 is comprised of a main member 62 and 63, and an arm member 65. The main member (driving portion) 62 and 63 is fixed to a downstream upright 13*b* of the first tandem press 10. The arm member 65 can enter into or retract from the first and second pressing stations W1 and W2 of the first and second tandem presses 10 and 20.

In detail, a first main portion 62 is disposed in the space formed among the slide 15 of the first tandem press 10, the slide 25 of the second tandem press 20, and one side uprights 13*b* and 23*a*.

It is fixed to an inner side surface of the intermediate portion of the uprights 13*b* and 23*a* in the height direction. A second main portion 63 is joined to the first main portion 62, and extends in the space 5 between the first and second tandem presses 10 and 20 horizontally.

The arm member 65 includes a first arm portion 66 pivoted at a top end of the second main portion 63, and a second arm portion 67 pivoted at a top end of the first arm portion 66. The first arm portion 66 and the second arm portion 67 can rock in the horizontal plane so that a free end thereof moves along an arc track.

For moving the arm member 65 to the first pressing station W1, the first arm portion 66 is rocked, in the plane view, in the clockwise direction. Thereafter, the second arm portion 67 is rocked in the clockwise or anti-clockwise direction. On the other hand, when the arm member 65 is moved to the second pressing station W2, the first arm portion 66 is rocked, in the plane view, in the anti-clockwise direction. Thereafter, the second arm portion 67 is rocked in the anti-clockwise or clockwise direction.

According to this deformed sample, following peculiar advantages can be obtained. Firstly, the spaces existed in the first tandem press 10 and in the second tandem press 20, and the space existed between the both tandem presses 10 and 20, are utilized for disposing the work conveying apparatus 70. That is, apparent from FIGS. 5 and 6, the main member 62 and 63 is disposed in the space between the slide 15 and the upright 13*b* of the first tandem press 10, and the space between the slide 25 and the upright 23*a* of the second tandem press 20. Also, the arm member 65 is disposed in the downstream space of the first tandem press 10, and the upstream space of the second tandem press 20.

Secondary, construction of the work conveying apparatus 70 can be made simple. Disposing the main member 62 and 63 only at one side of the first and second tandem presses 10 and 20 reduces the numbers of the components and makes the operation simple.

The invention claimed is:

1. A tandem pressing apparatus comprising:

a tandem pressing line comprising a plurality of tandem presses disposed side by side, the plurality of tandem presses including an upstream tandem press and a downstream tandem press; and a work conveying apparatus for conveying a work (W) between the upstream tandem press and the downstream tandem press;

wherein each of the upstream tandem press and the downstream tandem press includes a bed, plural uprights studded on the bed, and a slide supported on the uprights to be ascended or descended;

wherein the work conveying apparatus includes a guiding member attached to at least one of a downstream upright of the upstream tandem press and an upstream upright of the downstream tandem press, an end of the guiding member extending substantially beyond the upstream upright of the downstream tandem press and the downstream upright of the upstream tandem press parallel to a conveying direction of the work;

wherein the work conveying apparatus includes a main member and an arm member, the main member being connected to the guiding member and being provided at a portion located between the slide of at least one tandem press of the tandem pressing line and an upright of the at least one tandem press, and not interfering with the slide; and wherein the arm member is movable between a position to enter into and retract from the upstream tandem press, and a position to enter into and retract from the downstream tandem press, for transferring the work from the upstream tandem press to the downstream tandem press.

2. A tandem pressing apparatus according to claim 1, wherein the main member is disposed in a space formed between the downstream upright of the upstream tandem press and the upstream upright of the downstream tandem press adjacent to the upstream tandem press, and including a space existing inside the upstream upright and the downstream upright.

3. A tandem pressing apparatus according to claim 2, wherein the main member is positioned outside a contour of the slide.

4. A tandem pressing apparatus according to claim 3, wherein the main member is fixed to the upright located at one side relative to the conveying direction of the work.

5. A tandem pressing apparatus according to claim 1, wherein the main member is slidably held by the guiding member, the guiding member being provided inside the downstream upright of the upstream tandem press and the upstream upright of the downstream tandem press.

6. A tandem pressing apparatus according to claim 5, wherein the main member, moved to the upstream tandem press or the downstream tandem press, is positioned outside a contour of the slide.

7. A tandem pressing apparatus according to claim 2, wherein the arm member is a multi-joint arm including two or more joints.

8. A tandem pressing apparatus according to claim 2, wherein the main member is fixed to at an intermediate portion of the upright in the height direction, and the arm member is extended laterally from the main member.

9. A tandem pressing apparatus according to claim 5, wherein the guiding member is fixed to at an intermediate portion of the upright in the height direction, and the arm member is extended downwardly from the main member.

10. A tandem pressing apparatus according to claim 2, wherein said work conveying apparatus is a conveying robot controlled by a CPU.

11. A tandem pressing apparatus according to claim 5, wherein the arm member is a multi-joint arm including two or more joints.

12. A tandem pressing apparatus according to claim 5, wherein said work conveying apparatus is a conveying robot controlled by a CPU.

13. A method of pressing a work, comprising:

providing a tandem pressing apparatus, said apparatus comprising a tandem pressing line comprising: a plurality of tandem presses disposed adjacent one another, the plurality of tandem presses including an upstream tandem press and a downstream tandem press; and a conveying apparatus for conveying the work between said upstream tandem press and said downstream tandem press;

wherein each of the upstream tandem press and the downstream tandem press comprises a bed, plural uprights, studded on the bed, and a slide supported on the uprights to be ascended or descended;

wherein the work conveying apparatus includes a guiding member attached to at least one of a downstream upright of the upstream tandem press and an upstream upright of the downstream tandem press, an end of the guiding member extending substantially beyond the upstream upright of the downstream tandem press and the downstream upright of the upstream tandem press parallel to a conveying direction of the work;

wherein the work conveying apparatus comprises a main member and an arm member, said main member being connected to the guiding member and being provided at a position located inside the uprights of an adjacent pair of tandem presses, and not interfering with the slide; and wherein the arm member is movable between a first position to enter into and retract from the upstream tandem press, and a second position to enter into and retract from the downstream tandem press, for transferring the work from the upstream tandem press to the downstream tandem press;

moving the arm member into the upstream tandem press when the slide of the upstream tandem press ascends;

catching the work with the arm member;

moving the arm member and the work out of the upstream tandem press;

moving the arm member and the work to the slide of the downstream tandem press;

leaving the work within the downstream tandem press; and moving the arm member out of the downstream tandem press.

14. A method of pressing a work, comprising:

providing a processing apparatus, comprising upstream and downstream presses disposed adjacent one another, and a conveying apparatus conveying the work between the upstream press and the downstream press, each of said presses comprising a slide for receiving the work, and said work conveying apparatus comprising a guiding member, a main members and an arm member, said main member being connected to the guiding member and provided at a position not interfering with the slide, and said arm member being movable between a first position entering into and retracting from the upstream press, and a second position entering into and retracting from the downstream press, to thereby transfer the work from the upstream press to the downstream press;

wherein the guiding member is attached to at least one of a downstream upright of the upstream tandem press and an upstream upright of the downstream tandem press, an end of the guiding member extending substantially beyond the upstream upright of the downstream tandem press and the downstream upright of the upstream tandem press parallel to a conveying direction of the work;

moving the arm member to the first position when the slide of the upstream press ascends;

acquiring the work with the arm member;

moving the work to the downstream press; and depositing the work on the downstream press.

* * * * *